United States Patent [19]

Aubert

[11] 4,275,973

[45] Jun. 30, 1981

[54] INSTALLATION FOR ACCELERATING NAVIGATION OF A WATER RAMP AND METHOD RELATING THERETO

[76] Inventor: Jean Aubert, 8 rue la Boétie, 75008 Paris, France

[21] Appl. No.: 69,183

[22] Filed: Aug. 23, 1979

[30] Foreign Application Priority Data

Sep. 7, 1978 [FR] France ..... 78 25727

[51] Int. Cl.[3] ..... E02C 3/00

[52] U.S. Cl. ..... 405/86; 405/85

[58] Field of Search ..... 405/1-7, 405/84, 85, 86

[56] References Cited

U.S. PATENT DOCUMENTS

| | | | |
|---|---|---|---|
| 3,287,916 | 11/1966 | Aubert | 405/86 |
| 3,396,540 | 8/1968 | Aubert | 405/85 |
| 3,514,958 | 6/1970 | Aubert | 405/86 |
| 3,656,305 | 4/1972 | Aubert | 405/86 |
| 3,686,871 | 8/1972 | Scholler et al. | 405/86 |
| 3,901,037 | 8/1975 | Aubert | 405/86 |

FOREIGN PATENT DOCUMENTS

| | | | |
|---|---|---|---|
| 1411084 | 8/1965 | France | 405/86 |
| 1580814 | 8/1965 | France | 405/86 |
| 2245211 | 4/1975 | France | 405/86 |

*Primary Examiner*—Dennis L. Taylor

*Attorney, Agent, or Firm*—Young & Thompson

[57] ABSTRACT

The installation enables an internal waterway to pass through a changing level by means of a water ramp connecting through a channel two water reaches respectively situated upstream and downstream and including basins for the storage of boats awaiting their turn before entering the water ramp. The upstream reach is provided with a tilting gate for the retention of the water, while a pusher provided with a transverse mask retaining a water-wedge on which the boat to be moved floats is movable along the channel to ensure the transfer of this boat from the downstream reach to the upstream reach and vice versa. The retaining gate for the upstream reach is located at a certain distance beyond the upstream end of the water ramp and a second retractable gate is arranged substantially at the end of the water ramp, these two gates bounding between themselves an intermediate horizontal reach, separating the upstream end of the water ramp and the upstream basin.

16 Claims, 26 Drawing Figures

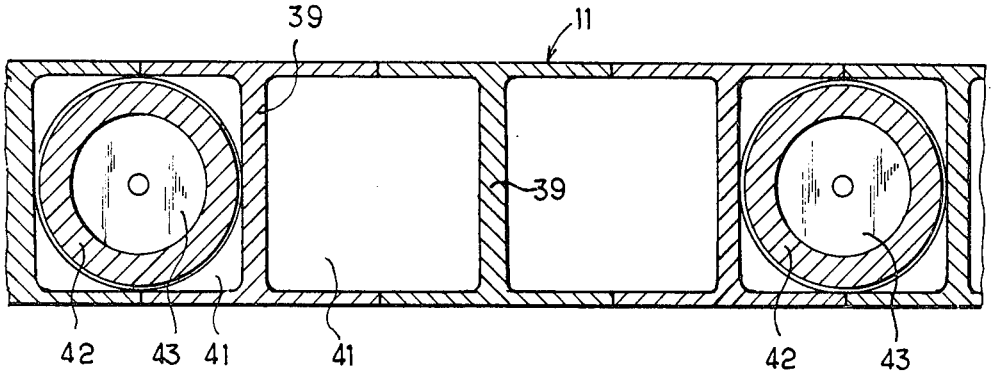
FIG. 7
FIG. 8
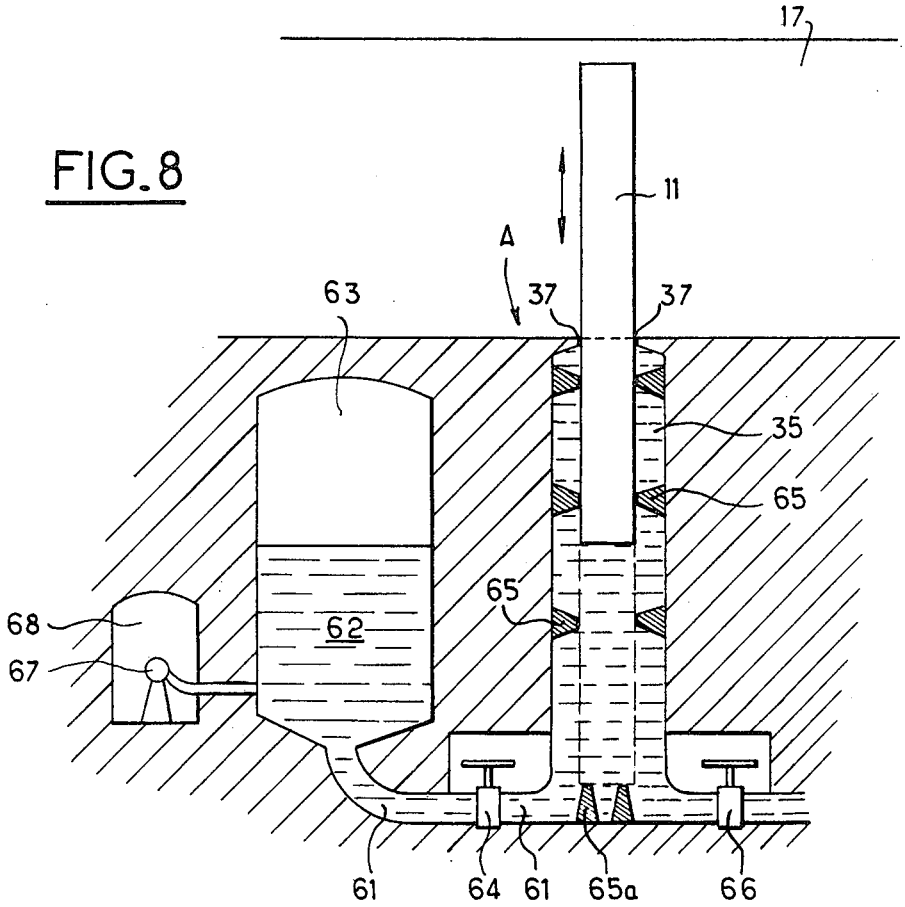

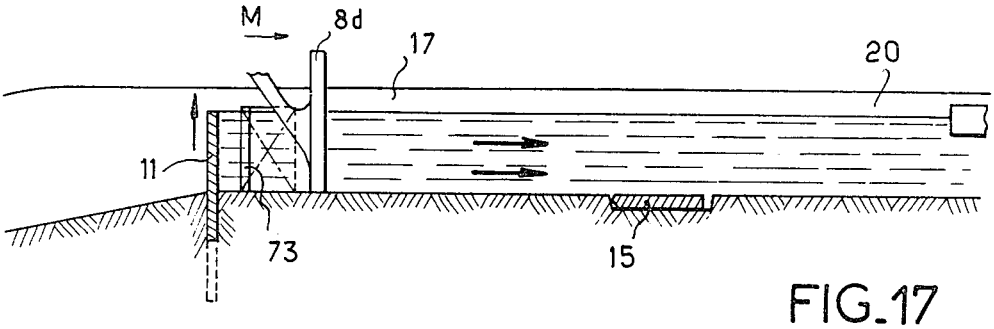
FIG. 17
FIG. 18
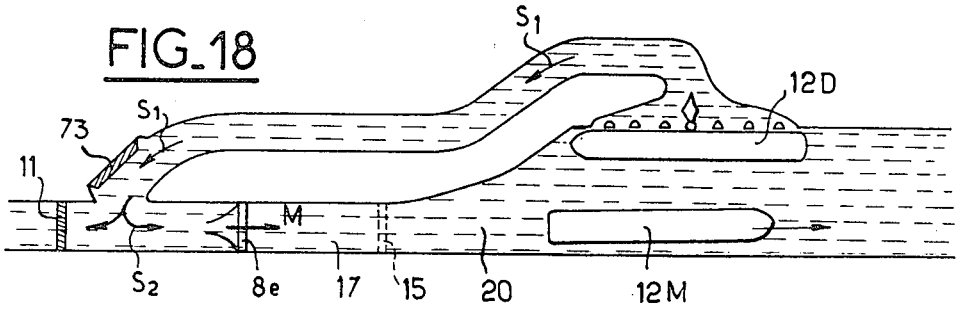
FIG. 19
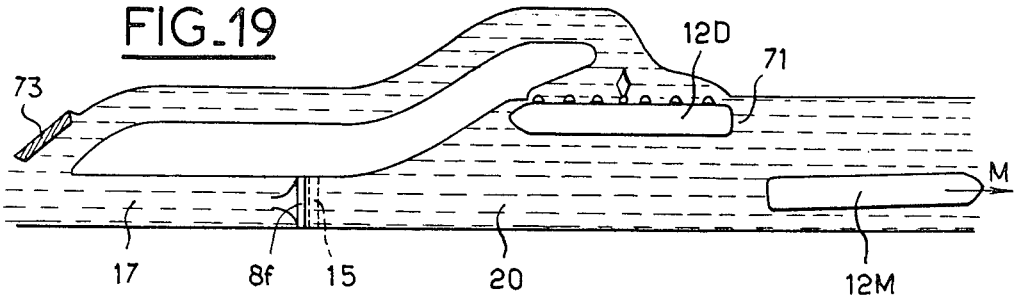
FIG. 20
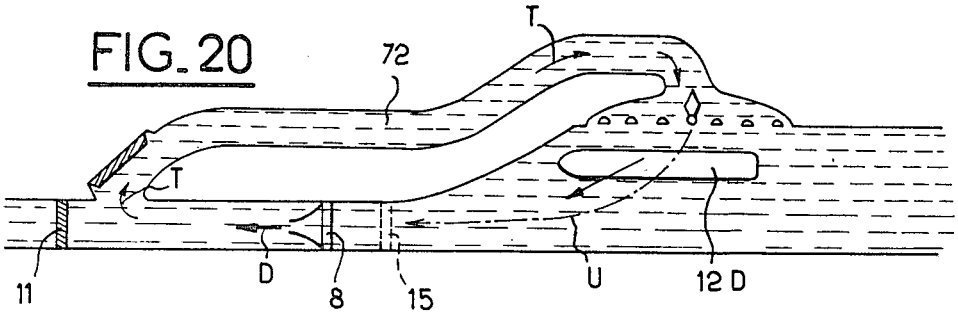

INSTALLATION FOR ACCELERATING NAVIGATION OF A WATER RAMP AND METHOD RELATING THERETO

BACKGROUND OF THE INVENTION

1. Field of the Invention

The present invention relates to an installation enabling the passage through a water ramp by boats navigating a canal to be accelerated, this acceleration being obtainable at the level of the upstream end and/or of the downstream end of the water ramp.

The invention relates also to a method particularly applicable to the abovesaid installation.

2. Description of the Prior Art

It is known that a water ramp is an engineering construction designed to replace locks when an inland waterway must pass through a considerable change in level.

The water ramp includes, between the downstream stretch or reach and the upstream reach—which is necessarily closed downstream by a gate—an inclined channel (also called a "trench"), with a substantially rectangular cross-section, whose walls (called "lock-walls") and bottom (also called "bed") are of masonry.

Along this channel, a pusher runs over runways driving a panel called a "mask" (or "shield") transversely obturating the channel. The mask constitutes a substantially fluid-tight closure of the channel, so that it can retain on its upstream surface a certain volume of water. By reason of the slope, the longitudinal vertical cross-section of this volume is triangular and the water mass is in the form of a wedge. A boat floating on this water-wedge, which thus constitutes a movable reach, is lifted or lowered therewith when the pusher is moved along the channel. By its to-and-fro movement, the movable reach ensures the transfer of boats from the downstream stretch to the upstream stretch and vice-versa.

It is particularly for the passage through a considerable change in level that the construction of a water ramp becomes more advantageous than that of a simple lock or a storage basin lock.

Consideration of the duration of the cycle is important, both as regards the lock and as regards the water ramp. It is known that this duration is that which runs between transits of a certain point by two boats or by two convoys navigating in the same direction.

In the case of a lock, the duration of the cycle is equal to the sum of the elementary times corresponding to the following operations, which must necessarily succeed one another:

- at the downstream head, the exit of the descending boat and the entrance of the ascending boat,
- closing of the downstream gate,
- filling of the lock,
- opening of the upstream gate,
- at the upstream end, exit of the ascending boat and entrance of the descending boat,
- closing of the upstream gate,
- emptying of the lock,
- opening of the downstream gate.

In summary, the duration of the cycle of a lock comprises:

- four gate operations,
- filling and emptying of the lock,
- exchanges of boats upstream and downstream.

In the cycle of a water ramp, similar elements are again found.

The gate operations, which are rapid in the case of a lock, are still faster in the case of a water ramp. Their duration is not even to be reckoned separately, since they are carried out at the same time as the water flows.

The filling and emptying of the lock are replaced by the ascent and descent of the water-wedge. At the present time, the movement of this wedge at a higher speed than three meters per second is not contemplated. Especially for very high water ramps, these movements require more time than the filling and emptying of the lock, of which operations the speed is however limited by the necessity of not removing or of injecting, into the stretches situated upstream and downstream of the structure, flow rates higher than those which produce in said stretches currents acceptable by boats in movement or stationary.

The boat exchanges at the two heads correspond, in the case of locks, to a very large fraction of the duration of the cycle. As will be seen, these exchanges can be faster in the case of water ramps and it is a specific object of the present invention to accelerate these exchanges.

To reduce the duration of the cycle of water ramps, it is advantageous to exploit to the maximum this possibility of reducing the time of the exchanges. It will be noted particularly that, in the matter of locks, the movements of boats are necessarily rather slow, because they are carried out by using exclusively the own engines of these boats, whose power is small relative to the masses to be moved. In the matter of water ramps, it is indicated to use in addition, for these movements, the considerable power of the pusher.

The expulsion of the boat or of the convoy, which must emerge from the water-wedge, is relatively easy, whilst the operation of introduction is complicated by the fact that the waiting boat stands in a lateral position with respect to the axis of navigation, which coincides with the axis of the inclined channel. Now, this axis of navigation must, in the first stage, be reserved for the emerging boat. After its exit, a lateral movement of the waiting boat is necessary before the latter can be introduced into the water-wedge.

This necessity has been taken into account in French Pat. No. 73 33932 of Sept. 21, 1973 of Applicant.

This patent relates to arrangements of the water ramp and the method relating thereto applicable both to the upstream end and the downstream end of the water ramp. These arrangements will be recalled below to distinguish them well from the present invention, considering only, for simplification, the upstream end.

At the downstream end of the upstream stretch, immediately upstream of the tilting gate, there is provided on the right bank a boat storage basin. The latter is constituted by a wall of the bank of which the waiting boat hauls alongside. This wall is pierced with orifices, so that the water can pass from the channel into a tank situated on the other side of the wall, or conversely. The tank is extended by a branch ending just downstream of the tilting gate, a gate enabling communication to be established or suppressed.

A second tank is arranged on the left bank, opposite the first, or a little more downstream. It is limited by a wall pierced with orifices and it is also extended by a branch closed by a gate at its end. By opening said gate, water is removed to the outside of the structure.

These two tanks are utilized to create a rectilinear transverse water current moving the boat which is stationary in the basin, from the right hand bank towards the left hand bank, so that it may become positioned substantially on the axis of the trench. To do this, water is sent into the right bank pipe and the gate which closes that of the left hand bank is opened.

The water supply of the pipe of the right hand bank is obtained by causing the mask to advance upstream in the direction of the tilting gate, which has been lifted and locked in vertical position immediately after the exit of the ascending boat. This movement of the mask reduces the volume comprised between it and the tilting gate, so that the water escapes laterally into the branch.

When the positioning of the descending boat substantially on the axis of the trench has been accomplished, it remains to cause it to enter the latter. This second movement is obtained by closing the gates of the two branches, by opening the tilting gate and by moving the mask from upstream to downstream. In this way an aspiration is created which draws the boat, the latter using its engine simultaneously.

The experiment carried out at the Montech site, in France, showed Applicant that this method was effective, but that it was not fully satisfactory, if only by reason of the civil engineering costs involved in the construction of two tanks. On the other hand, it is difficult in the transverse movement of the boat which should be a simple translation, to avoid a certain rotation. The creation of the transverse current results also in a troublesome loss of water. Finally, the fact that the boat no longer has appreciable speed at the beginning of the withdrawal does not permit it to become engaged fast enough in the intermediate space situated downstream of the tilting gate.

It is an object of the present invention to overcome these drawbacks by a simple and relatively uncomplicated installation and by means of an easy method of operation, fully profiting from the capacity of the pusher driving the mask.

It is also an object of the invention to exploit the means thus provided to limit as much as possible the volume of the water-wedge transported, for given boat length and draft, whilst avoiding certain difficulties connected with the passage of the water-wedge from the top of the inclined channel to the horizontal upstream stretch.

GENERAL DESCRIPTION OF THE INVENTION

According to the invention, an installation enabling the passage of boats through a change of level on an inland waterway by means of a water ramp connecting, through an inclined channel, two reaches respectively situated upstream and downstream and comprising boat storage basins for accomodating boats awaiting their turn before proceeding into the inclined channel, the upstream reach being provided with a tilting gate for retaining the water, whilst a pusher, provided with a transverse mask retaining a water-wedge on which a boat to be moved floats, is movable along the channel to ensure the transfer of said boat from the downstream reach to the upstream reach and vice versa, the retaining gate of the upstream reach being installed at a certain distance beyond the upstream end of the inclined channel and a second retractable gate being arranged substantially at the end of the inclined channel, these two gates defining between them an intermediate horizontal reach, separating the upstream end of the inclined channel and the upstream boat storage basin, is characterized in that said installation comprises runways for the pusher driving the mask, said runways being extended beyond the lock-walls of the inclined channel along the banks of the intermediate reach, and means to enable the passage of this pusher from the inclined channel to the intermediate reach and vice versa, as well as the travel of this pusher along the intermediate reach.

In an advantageous embodiment, by way of the aforesaid means, the trap-door is mounted for vertical sliding, in an orientation perpendicular to the axis of the intermediate stretch, this trap-door being fully retractable, through an aperture of the bed, into a subterranean chamber provided with operating means for said trap-door, sealing means being provided between the trap-door and the edges of the aforesaid aperture.

Preferably also, the means provided to enable the passage of the pusher from the inclined channel into the intermediate stretch, or reversely, comprise also a system for balancing the movable mask by counterweights, notably limiting the apparent weight of the mask on the bed whatever the inclination of the pusher.

In an important embodiment of the invention, the installation comprises a single branch channel, connecting the intermediate stretch to the boat storage basin of the upstream stretch, this channel being situated on the bank of the boat storage area and opening, on the one hand, close to the trap-door in the downstream part of the intermediate stretch where it can be closed by a retractable gate and, on the other hand, in the wall of the upstream storage area, the end of this duct being oriented transversely to said wall. This channel enables, as will be seen, the creation with the mask of a closed circuit drive effect, in alternate directions, very favorable to the exchange of boats.

In an advantageous embodiment, the end of the branch channel situated on the side of the storage area forms a transversely flared tank which opens into the bowl of the upstream storage basin through a succession of openings staggered along this bowl and this tank contains, in its middle part, adjustable orientation deflector means, such as a rudder, to distribute the water current of the branch channel preferentially towards one part or the other of staggered openings of this tank. In this way the operation of the boats is facilitated by an hydrodynamic way.

The invention relates also to a method notably for the operation of an installation of the aforesaid type, characterized in that, by the advance of the mask upstream, along the intermediate stretch, there is driven into this intermediate stretch and then into the upstream stretch the water of the water-wedge at the same time as the boat which occurs therein after which this water-wedge is reconstituted by suction, this operation commencing by the sweeping of the mask in reverse direction of the intermediate stretch, the rapid suction current thus created also causing the drawing of the boat which has to descend.

Within the scope of this method, to reduce to the minimum the volume of the water-wedge, the trap-door of the intermediate stretch being lowered at the moment when the water of the water-wedge commences to be distributed over the bed of this stretch, this trap-door is raised gradually in order to maintain the water height in front of the mask substantially constant whilst enabling a certain pouring from above this gate in order to fill with a delay the intermediate stretch. It is thus possible to maintain the water draft without reducing the speed of advance of the mask.

Within the scope of the above-contemplated installation, comprising a branch channel between the intermediate reach and the boat storage basin of the upstream reach, this channel comprising, close to the trap-door, a retractable gate at the place where it opens into the intermediate reach, the method of the invention is characterized in that after the clearing by the mask of the trap-door and then of the initially closed gate of the branch duct, the latter gate is opened during the rest of the movement of the mask, until the return of the latter to the vicinity of said gate, so as to create, by the advance of the mask a water current in a closed circuit in the intermediate reach, the upstream basin and the branch duct, and then vice versa on the return of the mask.

The invention also provides that after having reached its extreme upstream position, in the vicinity of the tilting retaining gate of the upstream reach, the mask immediately commences its return movement towards the upstream end of the inclined channel. In the course of this operation which causes the drawing of the descending boat towards the intermediate reach, the operator of the pusher can, by remote control of the rudder of the tank, modify the orientation of the currents emerging from the branch duct, so as to correct the possible tendency of the boat of not remaining parallel to itself during the movement.

According to another aspect of the invention, the installation arranged at the downstream head of a water ramp comprising a boat storage basin, is characterized in that a single branch duct connects the downstream reach to the base of the inclined channel, this branch duct comprising a retractable gate at its junction with the inclined channel and a tank opening into the basin through a series of staggered openings, means being provided to enable the movement of the mask downstream, beyond the retractable gate of the branch duct.

Within the scope of this arrangement, the invention provides a method characterized in that the mask is lifted to be brought from the bow to the stern of the descending boat, and then again moved downstream, beyond the retractable gate of the branch duct, which is opened after its passage, so as to create a looped water current between the part of the boat reach preceding the downstream basin, the latter and the branch duct. The exchange of boats at the downstream end is thus notably accelerated.

Other features of the invention will also become evident from the following description.

BRIEF DESCRIPTION OF THE DRAWINGS

In the accompanying drawings given by way of non-limiting examples, various methods of construction of the installation according to the invention and the related phases of the method are given; more precisely:

FIG. 7 is a partial cross-sectional view along the line VII—VII of FIG. 6, FIG. 8 is a diagrammatic view similar to that of FIG. 5 showing another embodiment of the subterranean chamber with the trap-door that it contains, FIGS. 13 to 17 are views in elevation in longitudinal section showing the various stages of passage of the upstream portion of the inclined channel and of the intermediate horizontal reach, FIGS. 18 to 20 show in plan view the procedure of removal of the ascending boat and of movement of the descending boat.

DESCRIPTION OF PREFERRED EMBODIMENTS

Referring to the accompanying drawings, there will first be described various embodiments of the installation used by the invention. Then the method also provided by the invention of the passage through the water ramp and of exchange of boats will be explained, this method applying the previously described installations, first treating the case of the upstream head and then that of the downstream head.

Figure 1:
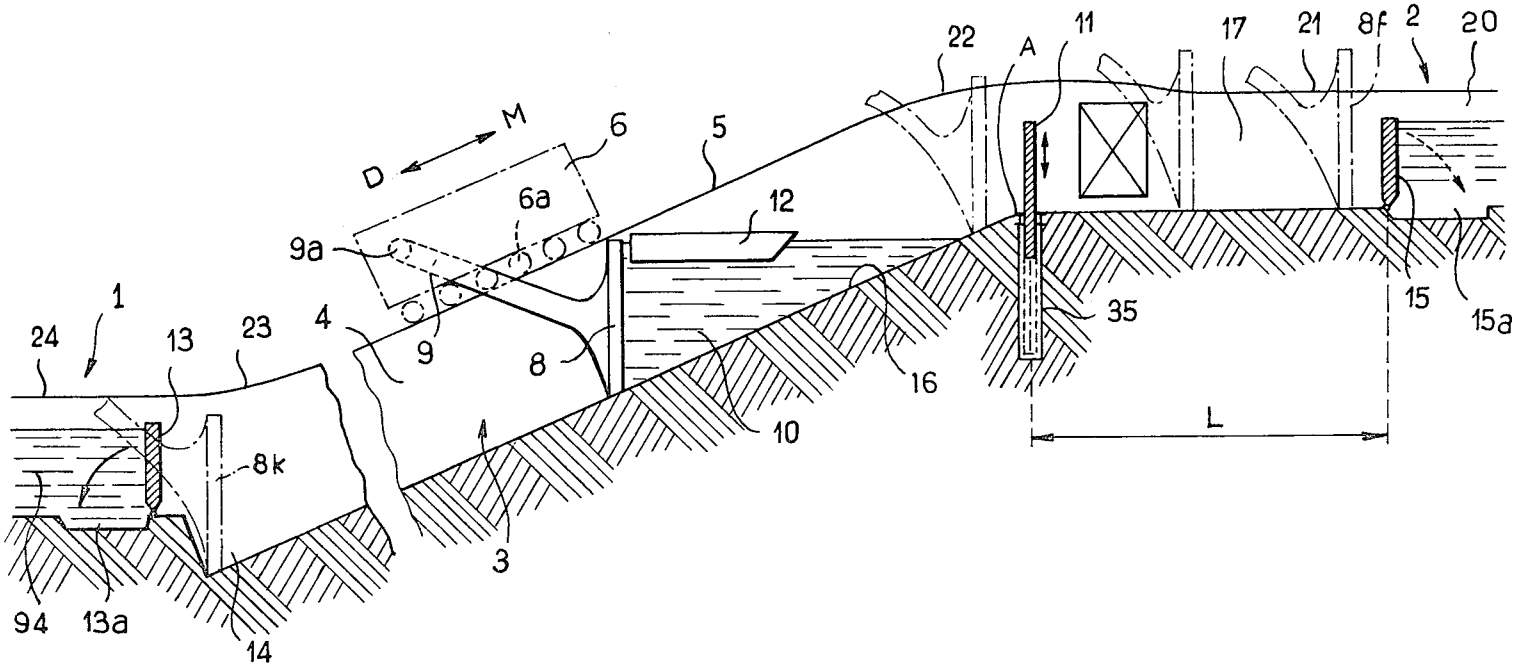
FIG. 1 is a view in elevation with portions torn away of one embodiment of a water ramp arranged according to the invention; for reasons of clarity, in this Figure and in the similar views which follow, the scale in the vertical direction is much larger than in the horizontal direction.

Referring to FIG. 1 of the accompanying drawings, there is seen at 1 the downstream head comprising a downstream reach 94 which is followed by a boat storage basin not visible in the figure, and at 2 the upstream head which also includes an upstream reach 20 followed by a ship storage basin (not shown). These two heads are connected by an inclined channel 3 constituting the water ramp proper. The channel 3 has a certain slope which, it seems must not ever be greater than 5%.

The side walls or lock-walls 4 of the channel 3 constitute runways 5 for a pusher 6, known in itself, comprising two longitudinal trains of drive wheels **6*a* supported on the runways 5. The pusher 6 is, on the other hand, provided with a mask 8 connected to boom-forming girders 9 and which are hinged at 9*a* to the frame of the pusher 6, the connections enabling the lifting of the mask from the inclined channel 3**, by means which will be described below.

The mask 8 enables the constitution of a water-wedge 10 retained between its wall, the lock-walls 4 and the floor or bed 16 of the channel 3. Various sealing means enable the movement of the mask in the ascending direction M or descending direction D. Other known means ensure fluid-tightness between the wall of this mask 8 and that of the channel 3, in the course of the movement. The water-wedge 10 enables the floating of an ascending or descending boat 12, or of a convoy.

The water ramp installation thus constituted includes also, at the junction of the downstream stretch 94 and of the channel 3, a retaining gate 13 with controlled automatic lifting and a pit 14 enabling the housing of the mask 8 when the latter comes into lower position of which the starting has been shown at 8*k* (in FIG. 1). A housing 13*a* is provided in the bed of the stretch 94 to receive the gate 13 when the latter is in withdrawn position.

In manner which is also already known, the upstream stretch 2 includes a tilting gate 15, called retaining gate which, in withdrawn position comes into a recess 15*a* of the bed of the reach 2. The gate 15 is designed to prevent the flow of water from the upstream stetch to the channel 3.

In accordance with one of the features of the present invention, the retaining gate 15 is implanted at a certain distance L beyond the upstream end A of the inclined channel 3. Complementarily, a second retractable gate 11—called trap-door—is arranged at the location A. The two gates 11 and 15 bound between them an intermediate horizontal stretch 17 of length L which separates the upstream end of the channel 3 and the terminal part of the upstream stretch 20 comprising the upstream storage basin for the boats.

Figure 2:
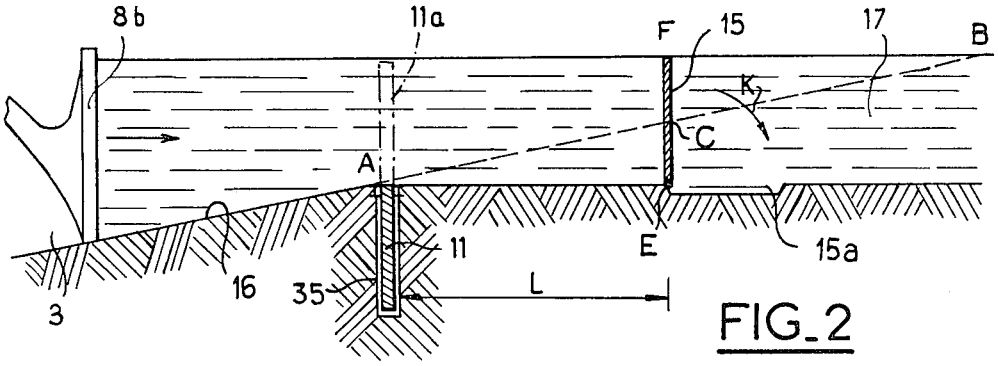
FIG. 2 shows the top portion of the water ramp and the beginning of the intermediate horizontal reach.

As is shown in FIG. 2, the aforesaid distance L is, preferably, such that the geometric extension A-B of the bed 16 of the inclined channel 3 passes substantially through the middle C of the retaining gate 15. Due to this fact, the two triangles-rectangles A C E and B C F are equal. This arrangement is productive of advantages which will be explained below.

According to another feature of the invention, the runways 5 provided for the pusher are extended at 21 along the banks of the intermediate stretch 17 to enable the mask to come into end position 8*f* substantially at the end of the reach 17 and in the immediate vicinity of the gate 15, and they are extended to 24 along the downstream stretch 94.

Other means are provided to enable the passage of the pusher from the inclined runways 5 to the horizontal runways 21 or vice versa, and to permit the movement of the pusher 6 beyond the gate 13 of the downstream reach 94 downstream. These means comprise the arrangement of a convex connecting surface 22 between the runways 5 and 21 and of a concave connecting surface 23 between the runways 5 and 24.

Figure 3:
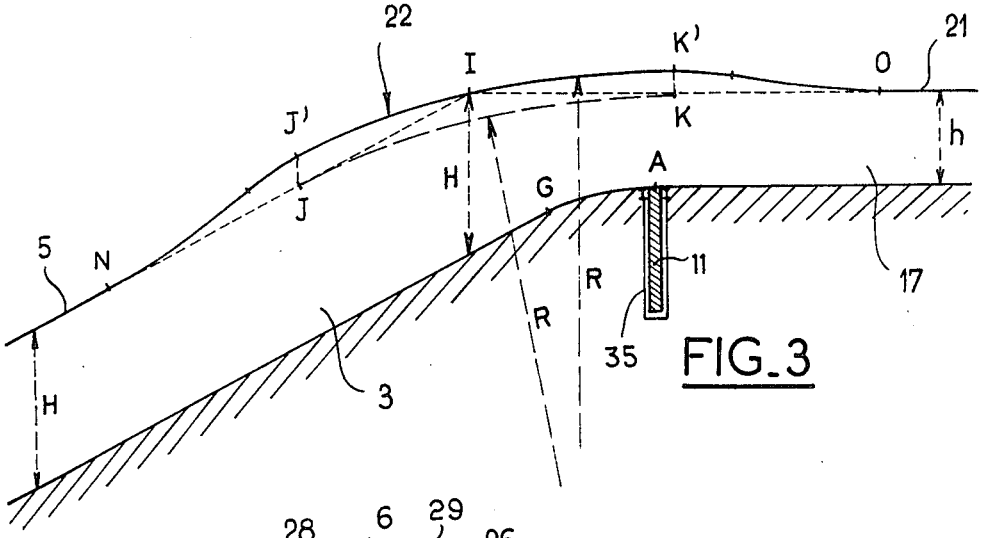
FIG. 3 shows the arrangement of the runways of the pusher at the connection between the upstream part of the inclined channel and the beginning of the intermediate reach of the upstream head.
Figure 4:
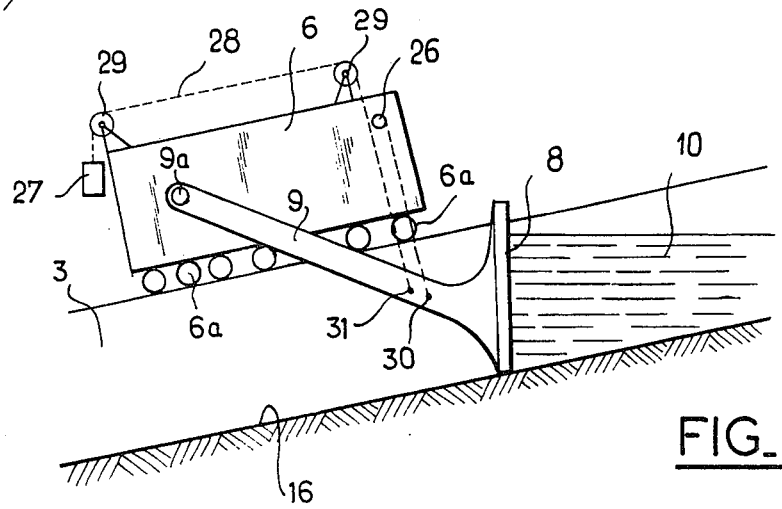
FIG. 4 is a diagrammatic side view showing the arrangement of the pusher bearing the mask.

A possible construction of the connecting runways 22 is shown in FIG. 3 where at AG is seen the connection of the beds of the channel 3 and of the stretch 17. For the arc AG a circle of relatively small radius may be accepted.

On the other hand, for the runway 22, a circle of very large radius (of the order of several kilometers) must be provided in order to avoid excessive crushing of the tires of the wheels 6*a* of the pusher 6 in the middle portion of the latter, at the moment of its change of slope.

Account must also be taken, as will be seen, of the elevation of the level of the water-wedge 10 with respect to the walls of the channel at the moment of this change of slope, which necessitates the raising at the spot concerned of the lock-walls whose height H in the channel 3 becomes h of smaller value in the stretch 17.

An advantageous geometric construction of the connecting runway 22 is the following:

(a) the two rectilinear runways 5 and 21 which meet each other at I are extended. A circular arc JK bi-tangential to the lines IJ and IK and of suitable radius R is selected, as has been indicated. For the line JK is substituted the line J'K' (parallel circular arc) passing through I.

(b) there is ensured, by inflexible curves of suitable length J'N and K'O, the connection between the aforesaid arc J'K' and the runways 5 and 21 respectively. Under these conditions, a height H of the channel 3 will be maintained in the connecting zone up to the vertical over the point I.

The pusher 6 must also be adapted to the movement on the runways 21 and 24 framing the inclined runways 5. In fact, the height h is normally very much less than the depth H of the channel 3. The mask 8 will hence occupy, during the movement over the horizontal levels, with respect to the body of the pusher 6, a position which will differ from that occupied in the ascent or descent along the channel 3. It has been established that it is not advantageous to roll the mask over the bed of this channel, since this would necessitate an expensive reinforcement of this bed. In addition, in order that the sealing device provided at the lower portion of the mask may ensure a suitable service life, the force urging it on the bed must not exceed some tons, that is to say a value very much less than the weight itself of the mask 8.

To respond to all of these conditions, the invention provides the pusher 6 both with lifting means for the mask 8, such as a winch 26 and balancing means for the same mask 8, constituted by lateral counterweights 27 attached by cables 28 which pass over return pulleys 29 of the pusher 6 and are attached to a boss 31 of the arms 9 of the mask 8. The counterweights 27 may be displaceable along shaped ramps forming cams (not shown) so that the apparent weight of the mask 8 on the bed 16 remains substantially constant whatever the relative inclination of the pusher 6 and of the mask 8. This arrangement presents the additional advantage of facilitating the manoeuvering of the mask 8 by the winch 26 by rendering these manoeuvers more rapid.

According to an important feature of the invention, the trap-door 11 arranged in the vicinity of the top A of the inclined channel 3 is mounted for vertical sliding in an orientation perpendicular to the longitudinal axis of the stretch 17. The trap-door 11 may be fully withdrawn into a subterranean chamber 35 (FIG. 5) of height at least equal, into which it is slideably mounted by passing through an opening 36 of the bed, sealing means 37 being arranged at the opening 36 to prevent the water of the channel from entering the chamber 35 whatever the position of the trap-door 11.

The trap-door 11 is, for example, constituted by a rectangular panel obtained by the assembly of wide silo beams so as to create an alveolar structure (FIG. 7). In certain of the cavities 41 thus formed are housed hydraulic jacks enabling the lowering and lifting manoeuver for the trap-door 11. These jacks comprise in particular cylinders 42 fixed between the walls of the cavities 41 and which extend over the greater part of the height of the trap-door 11. In these cylinders 42 are mounted fixed pistons 43 attached to vertical rods 44 whose base rests on a masonry footing 45. The pistons 43 and the rods 44 are traversed by axial canals 46 supplied from a high pressure station (not shown) by means of a distributor 47 housed in a widening 48 of the chamber 35, sufficiently large to permit visits to these members. Guide means are also provided in the chamber 35 to ensure a strictly vertical movement of the trap-door 11 whatever the hydrostatic pressures exerted on these walls. These guide means comprise, in the example concerned, a succession of staggered rollers 49 of number such that even in the upper position 11*b* of the trap-door 11, at least two superposed rows of rollers ensure the holding of this trap-door (position of FIG. 5). Laterally, the guidance of the trap-door 11 is ensured by direct support against the lock-walls 4 of the channel 3, without projections or grooves, but to facilitate the movements and assist fluid-tightness, the walls of the trap-door and of the lock-walls may be lined with sheet metal covered with slide plates, for example of fluorinated resin (notably polytetrafluoroethylene).

Figure 6:
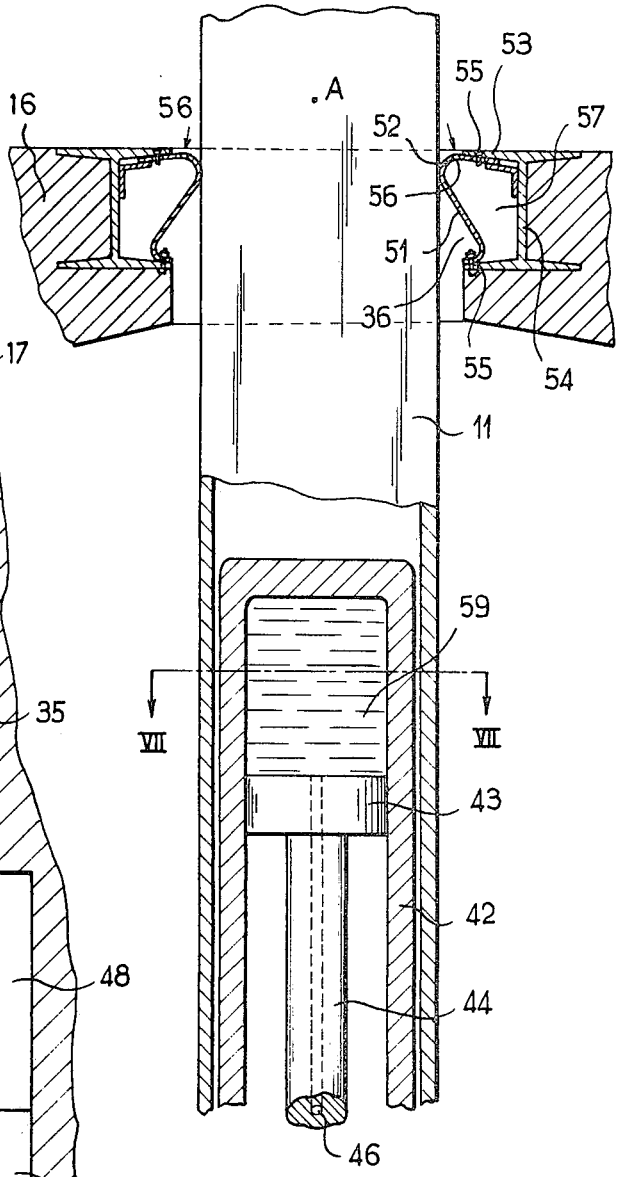
FIG. 6 is a view on a larger scale with a partial section of the trap-door showing the lifting and sealing means.

The sealing means 37 provided at the opening of the chamber 35 are shown in detail by way of example in FIG. 6. These means comprise shaped flexible sheets 51 having a convex portion 52 in sliding contact with the front surface of the trap door 11. The relatively flexible sheets 51 are fixed by rivets 55 or the like to the wings 53 of two bank shaped elements 54, bordering the opening 36. Certain openings 56 marked by arrows in FIG. 6 enable the communication of the inner space 57 arranged between the sheets 51 and the shaped elements 54 with the bed 16 of the circulation canal arranged above the subterranean chamber 55. For this reason, water enters the space 57 at high hydrostatic pressure whilst the opening 36 is at the pressure existing in the chamber 35, that is to say at atmospheric pressure. The sheets 51 are thus applied forcibly along their contact generator with the walls of the trap-door 11.

The chamber 35 includes also a sump 58 provided with drainage equipment in which the leakage water is collected which could have passed through the opening 36, and this in order to render the chamber 48 visitable.

It will be understood that in sending a hydraulic fluid under high pressure into the distributor 47 and the canals 46 of the piston rods 44, the chambers 59 formed between the pistons 43 and the cylinders 42 are filled. The expansion of these chambers causes the emergence upwards of the trap-door 11 guided by the rollers 49.

If on the contrary, the pressure is eliminated, the trap-door 11 redescends by itself into lower position 11*a* (FIG. 5), for which it is completely retracted inside the chamber 35, the top of the trap-door 11 then being at the level of the bed of the intermediate stretch 17. Due to the means provided, the operation of the trap-door 11 can be rapid. On the other hand, this door can rest without inconvenience at intermediate height.

Preferably, the operation of the trap-door 11 is remote-controlled from the control station of the pusher 6, this remote-control being ensurable by a radio link to a receiving station situated close to the point A.

Other means may be provided to ensure the operation of the trap-door 11. FIG. 8 gives another example thereof. In this embodiment, the subterranean chamber 35 is still full of water. To enable rapid ascent of the trap-door 11, the chamber 35 is connected by a pipe or duct of large diameter 61 to a water accumulator 62 held under pressure by a cushion of air or compressed gas 63. The piping can be open or closed by a cock 64, which is remote controlled. The accumulator 62 is constituted by a cavity lined with masonry, capable of resisting high pressure and water-tight and air-tight. To avoid having to compensate for air losses resulting from its solution in the water, the air can be emprisoned in an expandable envelope (not shown).

Figure 5:
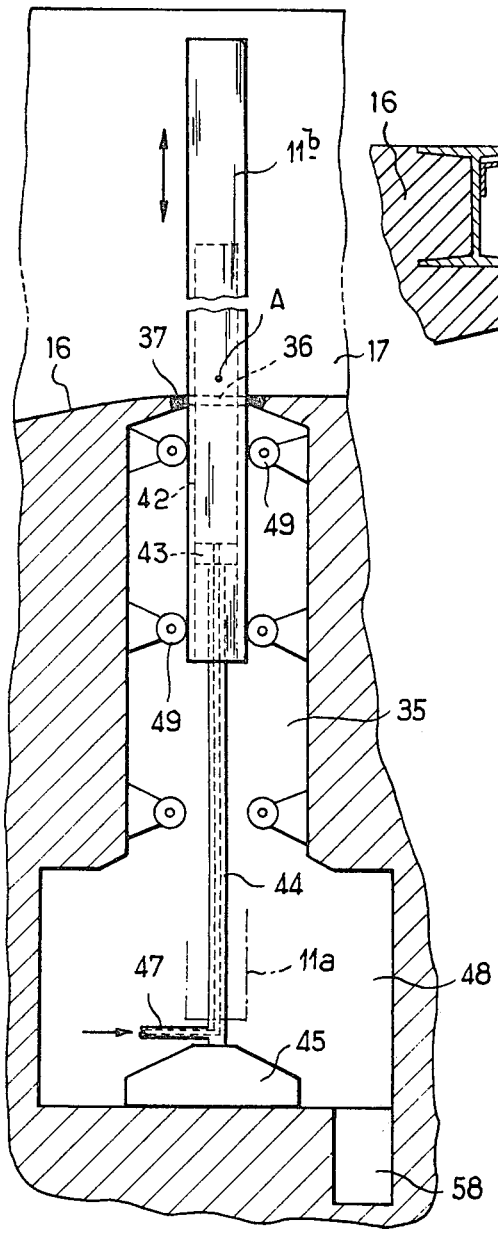
FIG. 5 is a partial cross-section on a larger scale of the subterranean chamber with the trap-door in the course of operation.

The sealing means 37 are similar to the system shown in detail in FIG. 5, but they operate in another sense: instead of preventing passage of water from above to below, they prevent a flow from below upwards.

In the chamber 35, rollers or studs 65, arranged at several levels, ensure the guidance over the two surfaces of the trap-door 11. They are arranged so that the subterranean chamber 35 can be visited by withdrawing the trap-door.

In the perpendicular direction, the guidance of the trap-door 11 is ensured by lock-walls 4 of the intermediate stretch 17 when this trap-door is in upper position, and by their extension downwards into the chamber 35 when it re-enters this chamber. No groove is arranged in the lock-walls 4 of the intermediate stretch, in order not to interfere with the passage of the mask 8. On the other hand, the surfaces against which the trap-door 11 rubs may be protected by imbedded metal sheet coated with fluorinated resin which contributes to the provision of sound fluid-tightness, when the trap-door 11 is in upper position.

When the trap-door 11 is lowered, it rests on bearing members 65*a*.

To cause the trap-door 11 to descend, the cock 64 is left closed, but another remote-controlled cock 66 is opened which enables the evacuation to the outside of a volume of water equal to the volume of the trap-door. To cause the latter to ascend, the cock 66 is closed and the cock 64 is opened which causes the chamber 65 to communicate with the accumulator 62.

After each descent of the trap-door 11, the accumulator 62 is resupplied with pressurized water by a motor pump unit 67 installed in the chamber 68.

The arrangement of the upstream head 2 of the water ramp will now be described, and then that of the downstream head 1, enabling the application of the claimed method of accelerated hydraulic movement of boats at the two heads of the water ramp, it being specified that it could be sufficient to arrange only for the upstream head or the downstream head if it is not desired to apply the invention to the full.

Figure 9:
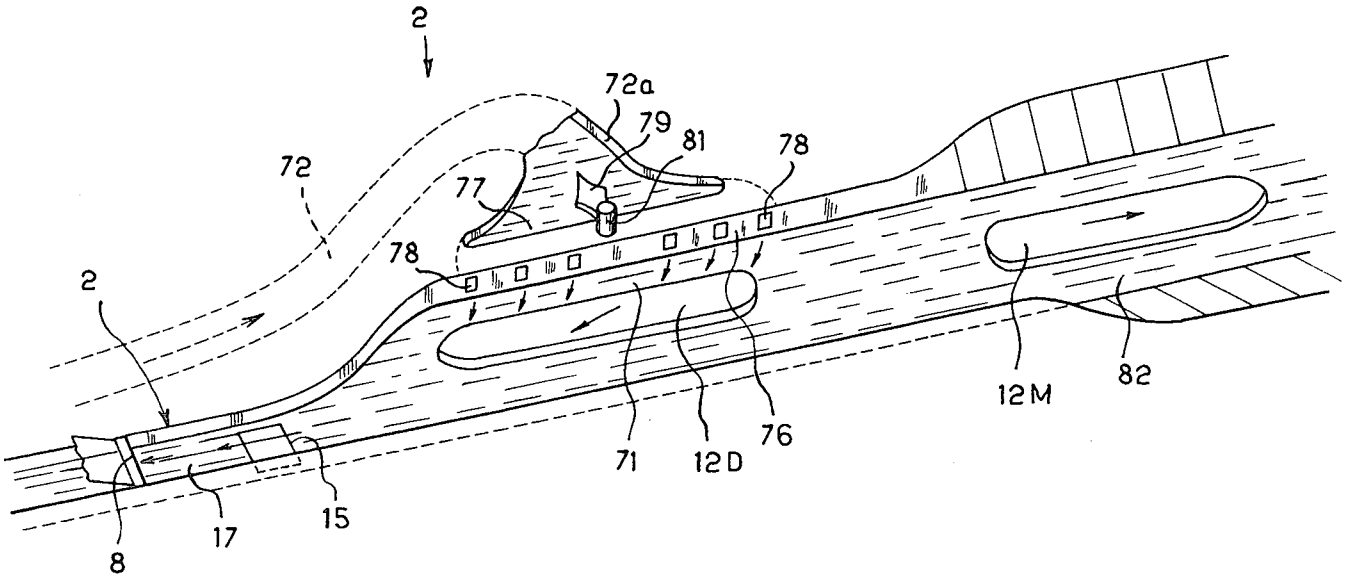
FIG. 9 is a perspective diagram showing in simplified manner the upstream reach with the ship storage basin and the intermediate channel.
Figure 10:
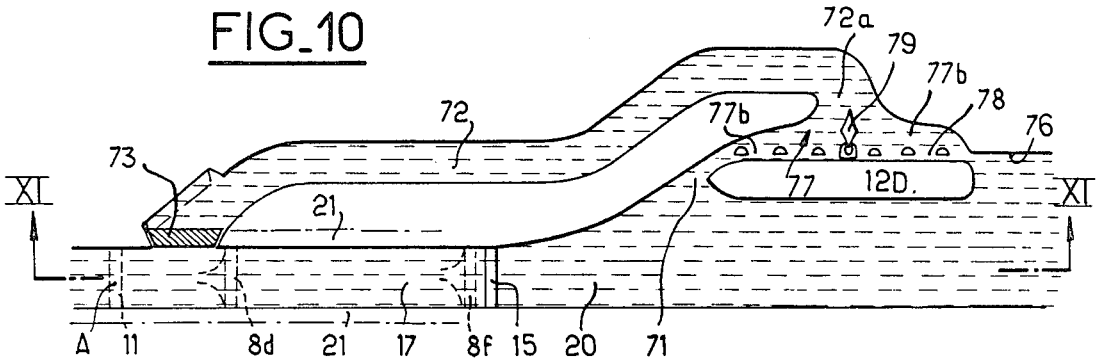
FIG. 10 is the plan view corresponding to FIG. 9.
Figure 11:
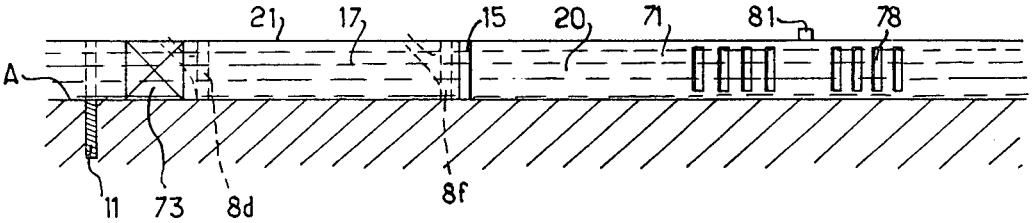
FIG. 11 is a longitudinal sectional view along the line XI—XI of FIG. 10.
Figure 12:
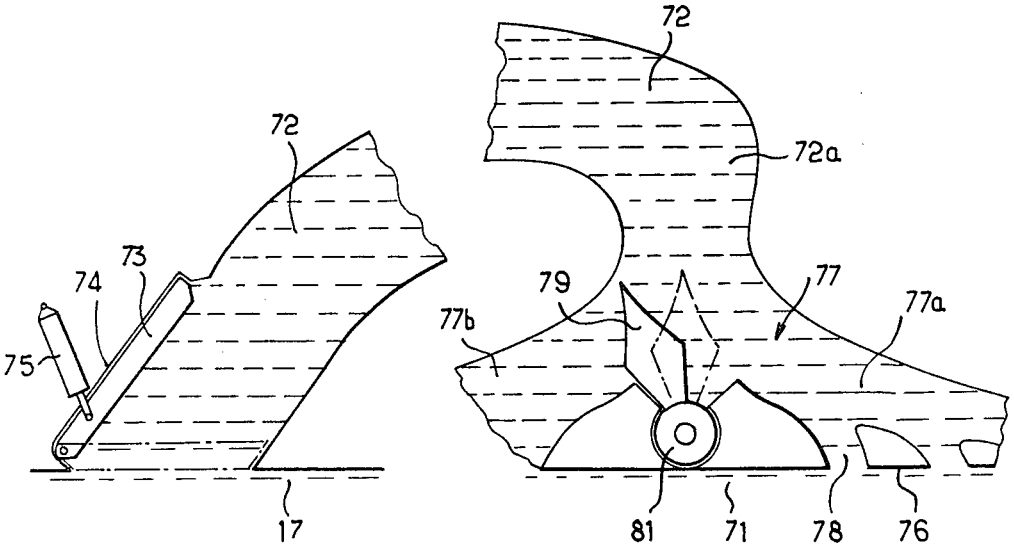
FIG. 12 is a diagrammatic view on a larger scale with portions torn away showing the inlet of the branch duct and a portion of the tank of the upstream ship storage basin.

In the embodiment concerned (FIGS. 9 to 11), the intermediate stretch 17 is doubled towards the upstream boat storage basin 71 (established for example on the left hand side of an ascending boat) by a single branch duct 72 constructed on the same bank as the basin 71. The duct 72 opens close to, but upstream of the trap-door 11, in the downstream part of the intermediate reach 17 where it is closed by a remote controlled retractable gate 73, capable of becoming housed in a recess 74 of the masonry (FIG. 12). The gate 73 is, for example, remote controlled by a hydraulic jack 75.

The other end of the duct 72 which can be partially or completely open to the sky, opens into the upstream basin 71, the end 72*a* of the duct being oriented transversely,—and notably perpendicularly—, to the wall 76 of the basin 71. At this end 72*a*, the duct forms a laterally flared tank 77 which opens into the bowl of the basin 71, through a succession of openings 78, staggered along one part of this bowl.

In its middle part, the tank 77 contains deflector means for the water currents, adjustable in orientation, such as a rudder 79 which is directed towards the end 72*a* of the duct 72.

The rudder 79 has, for example, the profile of the hand of a clock, as can be seen in FIG. 12 and it is actuated in rotation by a motor reducing gear unit 81 of vertical axis, itself remote controlled from the pusher 6. In its extreme lateral positions the rudder 79 can substantially obstruct one of the branches 77*a* or 77*b* of the tank 77.

The cumulative surface area of the various orifices 78 must be less than that of the duct 72, in order to realize a "spray cone" effect, ensuring substantially equal distribution of the discharge from the various orifices. The number, the shapes and the sizes of these orifices 78 could advantageously be studied on a reduced model, in each particular case.

In FIG. 12, the rudder 79 is represented in a dashed line in a middle position, which ensures equal distribution of the delivery rate between the two groups of orifices 78. The drawing in full lines corresponds to one position, which favors the upstream group of orifices.

There will now be described, with reference to FIGS. 1, 2, 4, 9 and more especially 13 to 20, the ascent of a boat 12M (or of a convoy) from the lower part of the inclined channel 3 to the upper channel 82 (see FIG. 9) and consecutively the descent of a boat 12D from the upstream storage basin 71 to the lower portion of the inclined channel 3.

The pusher 6 advancing in the direction M, thereby pushing in front of it the boat 12M which floats on the water-wedge 10, arrives at the runways 22. In the part G A of the course, a variation in the inclination of the mask 8 with respect to the body of the pusher 6 is observed. By means of the action of counterweights 27, the pressure of the mask on the bed remains nonetheless substantially constant, as has been explained above. During this advance, the trap-door 11 is retracted at 11*a* into the subterranean chamber 35, leaving open the downstream portion of the intermediate stretch 17. The tilting retention gate 15 is lifted and retains the water of the upstream stretch 20. The retractable gate 73 of the branch duct 72 closes the latter, so that the intermediate stretch 17 is dry.

When the upstream portion of the water-wedge 10 arrives at the point A and commences to flow over the bed of the intermediate stretch 17, the trap-door 11 is progressively raised again according to a relationship of movement coordinated with the advance of the mask 8, to enable a certain pouring over at 10*a* (FIG. 13) of the water-wedge, to maintain the water draft of the latter substantially constant, whilst gradually filling the stretch 17.

Figure 14:
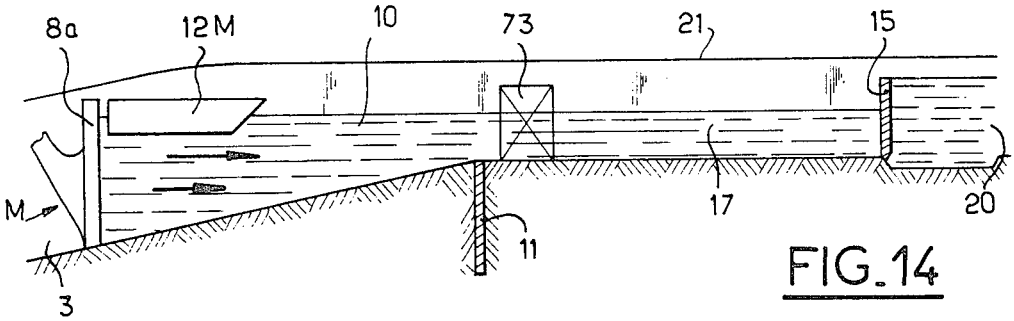

When the mask 8 has advanced sufficiently at 8*a* (FIG. 14), it becomes possible to withdraw the trap-door 11 completely into the chamber 35 without the water level in front of the mask dropping too much, which would unduly reduce the water draft necessary for the boat 12M.

When the water levels on both sides of the tilting gate 15 are equal (FIGS. 2 and 15), the mask 8 having arrived at 8*b* and the boat 12M having already penetrated into the stretch 17 both through its machinery and through the hydraulic thrust imparted by the mask 8, the gate 15 tilts towards its housing 15*a* along the arrow K.

At this moment, the mask 8 being at 8*b*, and taking into account the geometric position provided for the gate 15, as the surface area of the triangle A C E which corresponds to the filling of an additional surface area by the water-wedge 10 is equal to the surface area of the triangle B C F representing the portion of the water-wedge stopped by the gate 10, the gate 15 can tilt before the level of the water-wedge 10 in front of the mask 8 rises above the normal, as has already been indicated above with respect to the study of FIG. 2.

Figure 13:
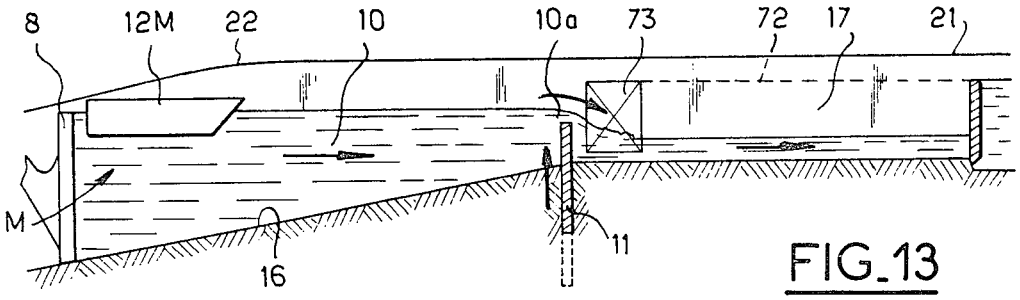

Correlatively, the presence of the trap-door 11 partially erected, avoids a lowering of the level of the water-wedge 10 when the mask 8 arrives in the vicinity of the position of FIG. 13.

Due to the relative position of the gates 11 and 15, it is hence unnecessary to provide an over-elevation of the level of the mask to prevent a portion of the water of the wedge 10 from pouring over its top, in the course of the period which immediately precedes the tilting of the gate 15.

In addition, the fact that the trap-door 11 is at least partially raised again when the mask 8 arrives in the position of FIG. 13, enables any scraping of the boat 12M on the bed 16. This avoids the need to raise an additional volume of water all along the trench, which precaution would have been necessary if it had not been arranged so that the level of the water in front of the mask should only be subject to small variations. In other words, the means provided by the invention enable the volume of the water wedge to be proportioned to the dimensions of the boat or of the convoy which has to be lifted; contrary to what occurs in a lock where the consumption of water corresponding to a lock filling cannot be reduced, even when it relates to a very small boat—only a small water wedge would have been pushed in front of the mask if a small boat had to be handled.

From the withdrawal of the retaining gate 15 (FIG. 15), the speed of advance of the mask 8 must be limited, to avoid it generating too violent a current in the intermediate stretch 17 and the upstream stretch 20.

Figure 16:
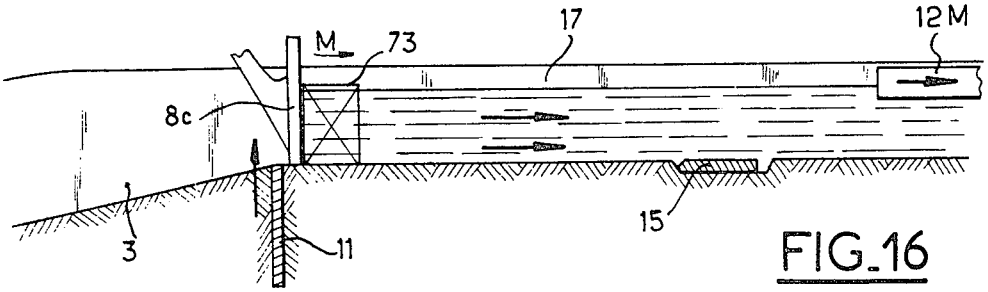

As soon as the mask 8 has reached the position 8*c* of FIG. 16 beyond the trap-door 11, the latter is raised behind it. When the trap-door is erected, as shown in FIG. 17, the mask 8 is found to have passed at 8*d* the lateral gate 73 of the channel 72 and this gate is then opened.

After this opening of the gate 73, the injection, into the upstream stretch 82, of the water coming from the wedge 10—which again fills the intermediate stretch 17—no longer risks being troublesome to the boats which are to be found in the upstream storage basin 71. FIG. 18 shows, in fact, that the gap, which would tend to be produced between the trap-door 11 and the downstream surface of the mask 8, causes in emerging from the duct 72, a flow $S_1$, $S_2$ for filling this gap, which compensates for the delivery injected by the mask into the upstream stretch 82. The speed of movement of the mask 8 from the position 8*e* which it occupies in FIG. 18, up to that of 8*f* which corresponds to FIG. 19 in the vicinity of the gate 15, is hence no longer limited by the consideration of the upstream stretch.

If the discharge from the branch duct 72 is too small, by reason of the throttling resulting from the limited surface area of the orifices 78 formed in the wall 76 of the upstream storage basin 71, it is possible to slightly lift the mask 8, during its movement over the support.

Figure 15:
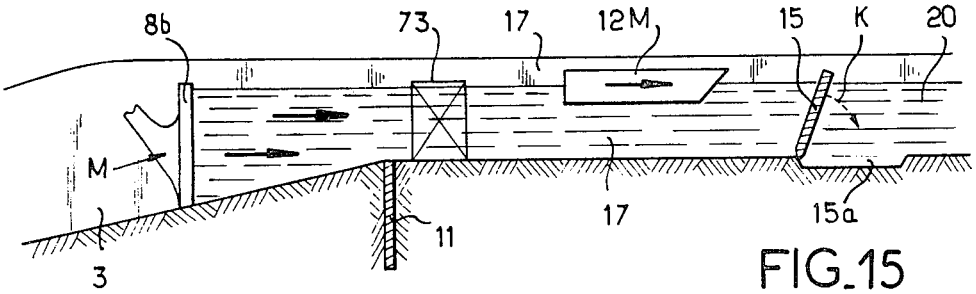

From the position of FIG. 15 and up to that of FIG. 19, the mask 8 has constantly contributed to the advance of the boat 12M ascending in the intermediate stretch 17, then in the upstream stretch 20. The propulsion method of the boat itself having operated in the same direction, at the moment corresponding to the FIG. 19, the ascending boat 12M has completely freed the path that the descending boat 12D must traverse.

The position of FIG. 19 hence marks, at the same time, the end of the period of injection into the upstream stretch 20 and the beginning of the period of drawing water to the intermediate stretch 17 in the direction D.

Under the effect of the movement of the mask in the direction D (FIG. 20), the water flows in the duct 72, in the direction T opposite that of its movement in the course of the preceding period.

The mixed line U of FIG. 20 represents substantially, at the same time, the water current of curved shape, which is generated by the withdrawal of the mask 8 and the path followed by the descending boat 12D. It is not certain that the latter would have to use its machinery to activate the movement endowed on it by the current. It is this principal process which ensures rapid penetration of the boat 12D into the water-wedge being formed, which will descend into the trench.

Initially, in the situation represented by FIG. 19, the boat 12D (or the convoy) in its stationary position has its middle substantially right behind the rudder 79. In the course of the movement along the curve U, the operator of the pusher 6 observes a tendency to angular movement of the boat 12D, he would correct this tendency by operating the rudder 79 by means of the remote controlled motor 81 (see FIG. 12).

In the course of the descending movement of the mask 8, subsequent to the situation shown in FIG. 20, the lateral gate 73 would be closed again before the arrival of the mask, whilst the trap-door 11 would be withdrawn.

The water necessary for the constitution of the new water-wedge would then be taken in the upstream stretch, the speed of this withdrawal being limited, as previously, for the injection.

It is when the wedge 10 would have reached the necessary volume that the tilting gate 15 would be lifted. It will be noted that, in the case of a propelled convoy, the volume of water necessary would be smaller on descending than on ascending. In fact, on descending, the tug, whose water draft is less than that of the loaded barges, would no longer be back-to-back with the mask. It can hence easily be housed in the tip of the water-wedge. The simple succession of the ascent and then of descent of two similar convoys hence will leave a positive water balance in the upper stretch.

It appears thus that the power of the pusher is put to advantage to create movements of water in a closed circuit, alternatively in one direction and then in the other, at the level of the upstream level to accelerate the movement itself and the exchange of boats.

By way of indication, the following example is supplied by way of comparison: in the case of a slope of 2% and a channel arranged for the passage of convoys of 5,000 tons, the volume of the water-wedge is close to 15,000 cubic meters. In addition, the speeds of injection and of withdrawal which it is preferable not to exceed are of the order of 75 cubic meters per second. This limitation is conventional in the case of locks, which are emptied and filled also to the advantage or detriment of the adjacent stretches.

To run in or withdraw 15,000 cubic meters, without exceeding the speed of 75 cubic meters per second, 200 seconds are required. With the assumed hypotheses, the absolute theoretical minimum of the time of exchange is hence 400 seconds. For the two exchanges which form part of one cycle, this minimum rises to 800 seconds namely 13 minutes 20 seconds. Taking into account the inevitable dead times and notably the necessity of transient rates, the practical duration to take into account for the two exchanges is doubtless of the order of 15 to 20 minutes. It will be noted that, within the above simplified reasoning, account has not been taken of the fact that a part of the 15,000 cubic meters concerned is injected or taken by a movement in closed circuit, which is without influence on the upstream stretch and whose speed is hence not limited.

It is the above figure of 15 to 20 minutes that it is possible to compare with some 45 minutes necessary for two exchanges of convoys of 5,000 tons in the case of a lock.

There will now be described, with reference to FIGS. 21 to 26, the arrangement of a downstream stretch in accordance with the invention and the method relating thereto. This description will be more summary, taking into account the analogies existing with the arrangement of the upstream head.

The pit 14 of the inclined channel 3 is connected by an inclined plane 93 to the downstream stretch 94, which is followed by a widening of the downstream channel 95, constituting a boat storage basin 96. As provided by the invention, a single branch duct 172, similar to the upstream duct 72, is arranged between one point of the trench 14 as upstream as possible and the basin 96. The duct 172 is provided as previously with a laterally retractable gate and opens into the storage basin 96 to a tank 177 arranged like the tank 77 by means of a series of staggered openings (not shown).

The runways 24 provided along the downstream stretch 94 enable the movement of the mask 8 downstream beyond the gate 173.

The conditions of exchange at the downstream head by the application of the method according to the invention, will now be explained.

Figure 21:
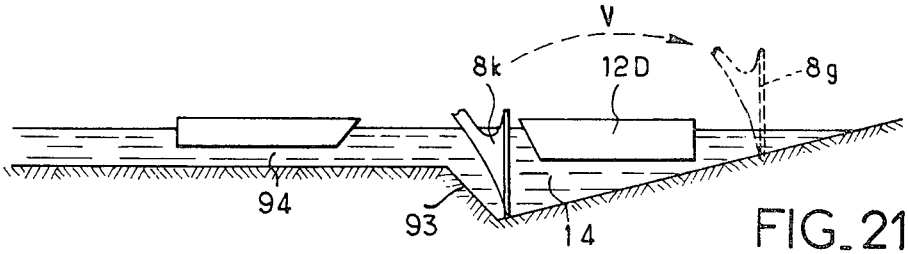
FIGS. 21, 23 and 25 are views in elevation in longitudinal section showing the various phases of a boat exchange at the downstream part of a water ramp provided with hydrodynamic means facilitating the movements of these boats.
Figure 22:
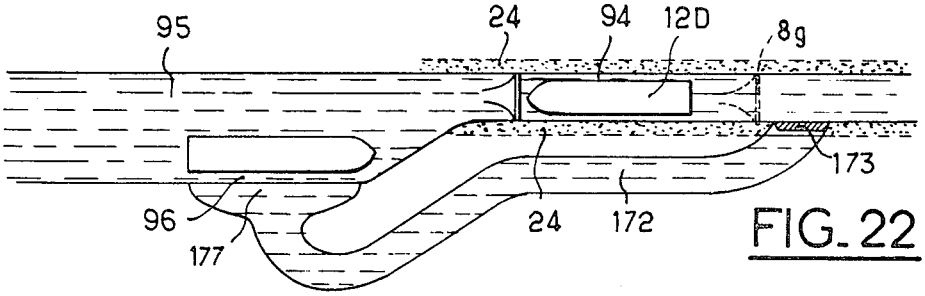
FIGS. 22, 24 and 26 are plan views corresponding respectively to FIGS. 21, 23 and 25.

The arrival of the descending boat 12D in the lower portion of the channel 3 is shown in FIGS. 21 and 22. If a gate 13 exists at this head, it will be held open during the whole exchage operation, and it is hence not shown.

The mask 8 is first lifted by the winch 26 and it passes (course V of FIG. 21) above the boat 12D during the movement of the pusher 6 upstream, then it is lowered to the position **8*g*, shown in dashed lines. As soon as the mask has been lifted, the boat 12D uses its machinery to start its departure downstream along D. During the movement of the mask upstream, the gate 173 of the channel 172** is opened.

Figure 23:
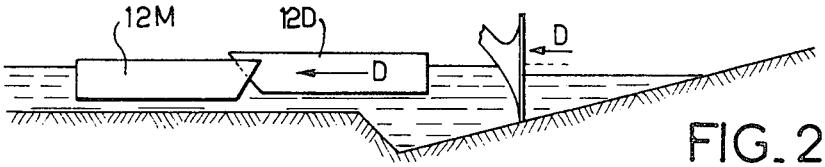
Figure 24:
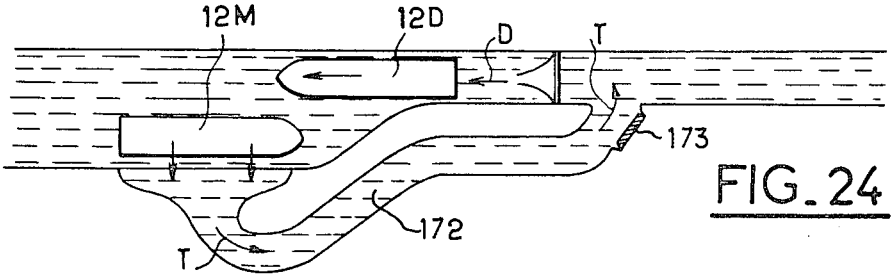
Figure 25:
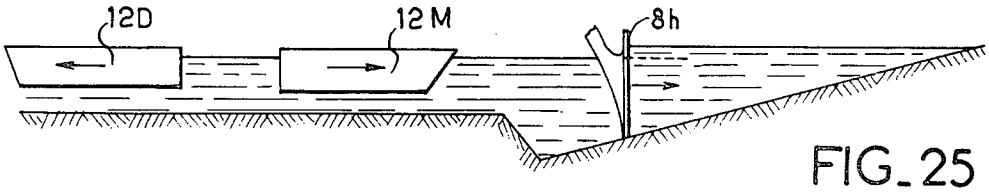
Figure 26:
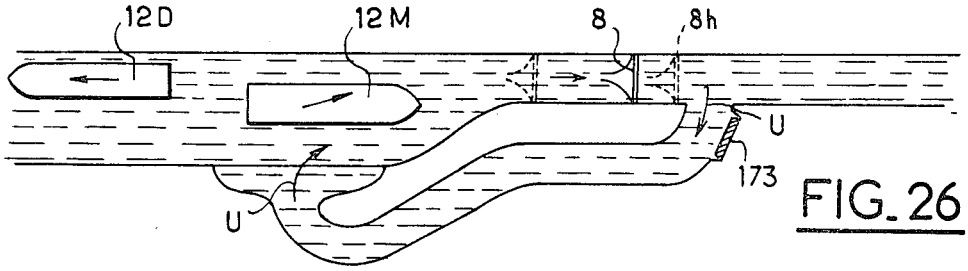

The mask once lowered at **8*g*, the pusher 6 is moved again downstream along D (FIG. 23). As with upstream, the movement of the mask produces a current in the form of a loop along T, as can be seen in FIG. 24. In FIGS. 25 and 26, the direction of the current is reversed (loop U) and the ascending boat 12M is drawn towards the pit 14 of the channel 3, the mask arriving thus at 8*h***.

The mask is then lifted again by bringing it behind the boat 12M, as has been done for the boat 12D. Once relowered, the mask is found to be in normal starting position and immediately starts its ascent.

It is observed that the balancing of the major portion of the weight of the mask 8 offers the additional advantage, which is not negligible, since it is desired to reduce the duration of the cycle, to enable the more rapid lifting or lowering of this mask, at the moment of the exchange of boats at the downstream head.

If a downstream gate is provided similar to the gate 13 of FIG. 1, but not shown in order to simplify FIGS. 21 to 26, the latter is lifted to avoid the level of the downstream stretch being influenced by the ascent of the water-wedge along the trench: rapid starting up of the pusher 6 is hence possible.

The method according to the invention presents the advantage of enabling, at each head, a more rapid emergence of the boat which has just passed through the change in level, and then a more rapid entrance of the boat about to enter the construction. It is in resorting to the considerable power of the pusher—which is found in any hypothesis to be immobilized at the heads during the exchange—that it is possible to accelerate this exchange. In the course of a cycle, two economies of time are thus effected, one arising from the exchange upstream and the other from the exchange downstream.

The installation claimed, which enables the use of the method which has just been described, has for the exploitation of a water ramp, another important advantage.

The water ramp being frequently at the end of a dividing stretch, it is necessary to supply the latter with water. The fact that the pusher can be engaged on the intermediate stretch to come almost into contact with the tilting gate, enables the supply of water with a very good yield to the dividing stretch. The whole of the water-wedge can, in fact, be injected into the upstream stretch. A portion of the water raised by the mask would redescend with it if it could not pass beyond the upper end of the inclined channel.

It is self-evident that the invention is not limited to the embodiments described and that it is possible to apply numerous modifications thereto, within the scope of the technician skilled in the art, according to the particular features of the site to be equipped which would still be within the scope of the invention as defined by the appended claims.

I claim:

1. Installation enabling the passage of boats through a change of level on an inland waterway by means of a water ramp connecting, through an inclined channel, two reaches respectively situated upstream and downstream and comprising boat storage basins for accommodating boats awaiting their turn before proceeding into the inclined channel, the upstream reach being provided with a tilting gate for retaining the water, whilst a pusher, provided with a transverse mask retaining a water-wedge on which a boat to be moved floats, is movable along the channel to ensure the transfer of said boat from the downstream reach to the upstream reach and vice versa, the retaining gate of the upstream reach being installed at a certain distance beyond the upstream end of the inclined channel and a second retractable gate being arranged substantially at the end of the inclined channel, these two gates defining between them an intermediate horizontal reach, separating the upstream end of the inclined channel and the upstream basin, said installation comprising runways for the pusher driving the mask, said runways being extended beyond the lock-walls of the inclined channel along the banks of the intermediate reach, and means to enable the passage of said pusher from the inclined channel to the intermediate reach and vice versa, as well as the travel of said pusher along the intermediate reach.

2. Installation according to claim 1, wherein the gate situated at the upstream end of the inclined channel called a trap-door, is mounted in slide vertically with an orientation perpendicular to the axis of the intermediate reach, said trap-door being fully retractable, through an opening of the bed, into a subterranean chamber provided with operating means for said trap-door, sealing means being provided between the trap-door and the edges of the aforesaid opening.

3. Installation according to claim 2, wherein the trap-door operating means comprise hydraulic jacks whose bodies are housed within the thickness of the trap-door.

4. Installation according to claim 2, wherein the trap-door operating means comprise a hydro-pneumatic reservoir connected to the subterranean chamber, means being provided to enable the admission into this chamber of liquid under pressure for lifting the gate.

5. Installation according to claim 1, wherein the means provided to enable the passage of the pusher from the inclined channel to the intermediate reach or conversely, comprise a system for balancing the movable mask by counterweights, notably limiting the apparent weight of the mask on the bed whatever the inclination of the pusher.

6. Installation according to claim 1, comprising a single lateral branch duct according to intermediate reach to the upstream basin, this duct being situated on the same bank as the basin and opening on the one hand, close to the trap-door in the downstream part on the intermediate reach where it can be closed by a retractable gate and, on the other hand, in the wall of the upstream basin, the end of this duct being oriented transversely to said wall.

7. Installation according to claim 6, in which the end of the branch duct situated at the side of the basin forms a laterally flared tank which opens into the bowl of the upstream basin through a series of openings staggered along this bowl, the flared tank containing in its middle part adjustable orientation deflector means, to distribute the water flow from the branch duct preferentially towards one part or the other of the staggered openings of this tank.

8. Installation according to claim 7, wherein said deflector means is a remote controlled rudder.

9. Installation according to claim 1, comprising means for the remote control of the retractable gates, and notably the trap-door, from the pusher.

10. Method for the operation of an installation according to claim 1, wherein by the upstream advance of the mask, along the intermediate reach, the water of the water-wedge is driven into this intermediate reach and then into the upstream reach, at the same time as the boat located therein, wherein, the retaining gate of the upstream reach being lifted and the trap-door of the intermediate reach being lowered at the moment when the water from the water-wedge starts to flow over the bed of this reach, the trap-door is raised gradually in order to maintain the height of the water substantially constant, in front of the mask whilst enabling a certain pouring over this gate for delayed filling of the intermediate reach and when equalization of the levels of the water-wedge and of the intermediate reach is approached, the trap-door is fully retracted to enable passage through it by the mask and then the trap-door is fully lifted after this passage.

11. Method for the operation of an installation according to claim 1, this installation comprising a branch duct between the intermediate reach and the basin of the upstream reach, this branch duct comprising, upstream of the trap-door, a retractable gate at the place where it opens into the intermediate reach, wherein after passage by the mask of the trap-door, then of the gate of the initially closed branch duct, the latter gate is opened and the trap-door is lifted during the rest of the movement of the mask, until the return of the latter to the vicinity of said gate, so as to create, by the advance of the mask, a closed circuit flow of water in the intermediate reach, in the upstream basin and the branch duct and then vice versa on the return of the mask.

12. Method according to claim 10, wherein after having reached its end upstream position, in the vicinity of the retaining gate of the upstream reach, the mask immediately starts its return movement to the upstream end of the inclined channel so as to create a flow of water in a closed circuit of opposite direction and wherein the water currents entering the upstream basin coming from the branch duct, on the return of the mask downstream, are oriented so as to push the descending boat towards the entrance of the intermediate reach.

13. Method according to claim 12, wherein in the course of the operation of drawing the descending boat towards the intermediate reach, the orientation of the currents emerging from the branch duct are modified, so as to correct the tendency which the boat could have of not remaining parallel to itself during the movement.

14. Installation adapted to the downstream head of a water ramp comprising a boat storage basin, in which a single branch duct connects the downstream reach to the base of the inclined channel, this branch duct comprising a retractable gate at its junction with the inclined channel and a tank opening into the basin through a series of staggered openings, means being provided to enable the circulation of the mask downstream beyond the retractable gate of the branch duct, the tank containing adjustable orientation deflector means to distribute the currents between the various openings of the tank.

15. Method for the operation of an installation according to claim 14, wherein the mask is lifted to be brought from the front to the rear of the descending boat, then again moved downstream, beyond the retractable gate of the branch duct, which is opened after its passage, so as to create a looped water current between the part of the reach preceding the downstream basin, into the latter and into the branch duct.

16. A method according to claim 15, wherein the direction of circulation of the water current in the loop is reversed, by the return of the mask upstream up to the base of the inclined channel, so as to facilitate the approach of the ascending boat, after which the mask is lifted and then brought back behind the latter before resuming its movement upstream.

* * * * *